US008277257B2

(12) United States Patent
Noguchi

(10) Patent No.: US 8,277,257 B2
(45) Date of Patent: Oct. 2, 2012

(54) CONNECTOR

(75) Inventor: Yutaka Noguchi, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 46 days.

(21) Appl. No.: 12/929,754

(22) Filed: Feb. 14, 2011

(65) Prior Publication Data

US 2011/0230102 A1 Sep. 22, 2011

(30) Foreign Application Priority Data

Mar. 17, 2010 (JP) ..... 2010-061012

(51) Int. Cl.
*H01R 25/00* (2006.01)

(52) U.S. Cl. ..... 439/640; 439/541.5; 439/945

(58) Field of Classification Search ..... 439/638, 439/640, 945
See application file for complete search history.

(56) References Cited

U.S. PATENT DOCUMENTS

| | | | | |
|---|---|---|---|---|
| 6,099,355 | A * | 8/2000 | Johnson et al. | 439/638 |
| 6,206,724 | B1 * | 3/2001 | Leung | 439/540.1 |
| 6,334,793 | B1 * | 1/2002 | Amoni et al. | 439/680 |
| 6,733,329 | B2 * | 5/2004 | Yang | 439/518 |
| 6,738,259 | B2 * | 5/2004 | Le et al. | 361/737 |
| 6,808,423 | B2 * | 10/2004 | Lin et al. | 439/630 |
| 7,467,977 | B1 | 12/2008 | Yi et al. | |
| 7,488,215 | B2 * | 2/2009 | Mayette et al. | 439/638 |
| 7,654,871 | B2 * | 2/2010 | Yi et al. | 439/660 |
| 7,806,704 | B2 | 10/2010 | Miyoshi et al. | |
| 8,079,878 | B2 * | 12/2011 | Huang | 439/660 |
| 2003/0148663 | A1 * | 8/2003 | Hsin | 439/638 |
| 2004/0038592 | A1 * | 2/2004 | Yang | 439/638 |
| 2011/0230102 | A1 * | 9/2011 | Noguchi | 439/640 |

FOREIGN PATENT DOCUMENTS

| | | |
|---|---|---|
| JP | 2009-272290 | 11/2009 |
| JP | 2010-27456 | 2/2010 |

* cited by examiner

*Primary Examiner* — James Harvey
(74) *Attorney, Agent, or Firm* — McGinn IP Law Group PLLC

(57) ABSTRACT

A connector connectable to a plurality of receptacles of different specifications is provided while a connector of the prior-art configuration is not adapted for the connection with such receptacles. The connector includes: a connector body; and a connector portion partially inserted in the connector body and partially projected from the connector body. The connector portion includes: a first connector block that is singularly capable of mating with a receptacle conforming to a first specification but is singularly incapable of mating with a receptacle conforming to a second specification; and a second connector block that is disposed on the first connector block and combined with the first connector block to be capable of mating with the receptacle conforming to the second specification. The second connector block is free to slide on the first connector block 21 and to be inserted in the connector body.

6 Claims, 11 Drawing Sheets

USB Series "B" Receptacle Interface

R2B

CONNECTOR

CROSS-REFERENCE TO RELATED APPLICATION

The disclosure of Japanese Patent Application No. 2010-61012 filed on Mar. 17, 2010 including the specification, drawings and abstract is incorporated herein by reference in its entirety.

BACKGROUND

1. Field of the Invention

The present invention relates to a connector connectable to a plurality of receptacles of different specifications.

2. Description of Related Art

Heretofore, a USB interface conforming to the USB (Universal Serial Bus) specification has been widely used as one of the data transmission means for connecting a personal computer or the like with peripherals such as key board, mouse and modem. USB connection is established by mating a USB connector attached to a distal end of a USB cable or the like with a USB receptacle installed in the personal computer or the like.

More recently, USB 3.0 Specification, which was upgraded from the prior USB 2.0 Specification by adding Super Speed Line (hereinafter, abbreviated as "SS Line"), has been standardized. The USB Standard includes USB connector and receptacle's Standard A and USB Standard B.

SUMMARY

A USB3.0 Std-A connector C3A shown in FIG. 3B comprises a USB2.0 Std-A connector C2A shown in FIG. 3A which is upgraded with an SS line structure S incorporated therein.

The outside configuration of the USB3.0 Std-A connector C3A is not changed from that of the USB2.0 Std-A connector C2A so that the USB3.0 Std-A connector C3A is connectable not only to a USB3.0 Std-A receptacle but also to a USB2.0 Std-A receptacle R2A shown in FIG. 3C. With a Standard-A product, therefore, a USB3.0 cable equipped with the USB3.0 Std-A connector C3A is also usable as a USB2.0 cable, offering an enhanced convenience.

On the other hand, a USB3.0 Std-B connector C3B shown in FIG. 4B comprises a USB2.0 Std-B connector C2B shown in FIG. 4A which is upgraded with the SS line structure S externally attached thereto.

The USB3.0 Std-B connector C3B has an outside configuration which is larger than that of the USB2.0 Std-B connector C2B. Therefore, the USB3.0 Std-B connector C3B is connectable to a USB3.0 Std-B receptacle R3B shown in FIG. 4D but not to a USB2.0 Std-B receptacle R2B shown in FIG. 4C.

According to the existing specification for standard B, a USB3.0 cable equipped with the USB3.0 Std-B connector C3B is not usable as the USB2.0 cable. This dictates the need for preparing two types of USB cables, namely the USB2.0 cable and the USB3.0 cable, and using either one of the cables as required by the circumstance. As a result, the convenience is hampered.

FIG. 3A, FIG. 3C, FIG. 4A and FIG. 4C are taken from Universal Serial Bus 2.0 Specification, Revision 2.0 (FIG. 3A: FIG. 6-2 (p 87), FIG. 3C: FIG. 6-7 (p 95), FIG. 4A: FIG. 6-2 (p. 87), FIG. 4C: FIG. 6-8 (p. 96)).

FIG. 3B, FIG. 4B and FIG. 4D are taken from Universal Serial Bus 3.0 Specification, Revision 1.0 (FIG. 3B: FIG. 5-2 (p. 79-80), FIG. 4B: FIG. 5-7 (p. 88), FIG. 4D: FIG. 5-6 (p 86)).

Japanese Patent Application Publication No. 2010-027456 discloses a connector conforming to two types of specifications. However, this connector comprises a connector originally conforming to two types of mutually compatible specifications and employing contacts forming a matched impedance differential pair. Therefore, this connector design does not impart compatibility to the USB2.0 Std-B connector and the USB3.0 Std-B connector which are incompatible with each other.

In accordance with the present invention, a connector comprises:

a connector body; and a connector portion partially inserted in the connector body and partially projected from the connector body, wherein the connector portion includes: a first connector block that is singularly capable of mating with a receptacle conforming to a first specification but is singularly incapable of mating with a receptacle conforming to a second specification; and a second connector block that is disposed on the first connector block and combined with the first connector block to be capable of mating with the receptacle conforming to the second specification, and wherein the second connector block is free to slide on the first connector block and to be inserted in the connector body.

The connector of the present invention having the above configuration permits the second connector block to be inserted in the connector body as required. Therefore, the connector can use the first connector block alone for mating engagement with the receptacle conforming to the first specification. Further, the connector can also use the first connector block together with the second connector block for mating engagement with the receptacle conforming to the second specification. Accordingly, the connector of the present invention is connectable to the receptacles of different specifications whereas a connector of the prior-art configuration is not adapted for the connection with such receptacles.

The present invention can offer the connector connectable to a plurality of receptacles of different specifications whereas the connector of the prior-art configuration is not adapted for the connection with such receptacles.

DETAILED DESCRIPTION OF THE PREFERRED EMBODIMENTS

A configuration of a connector according to one embodiment of the present invention will be described with reference to the accompanying drawings.

Figure 1:
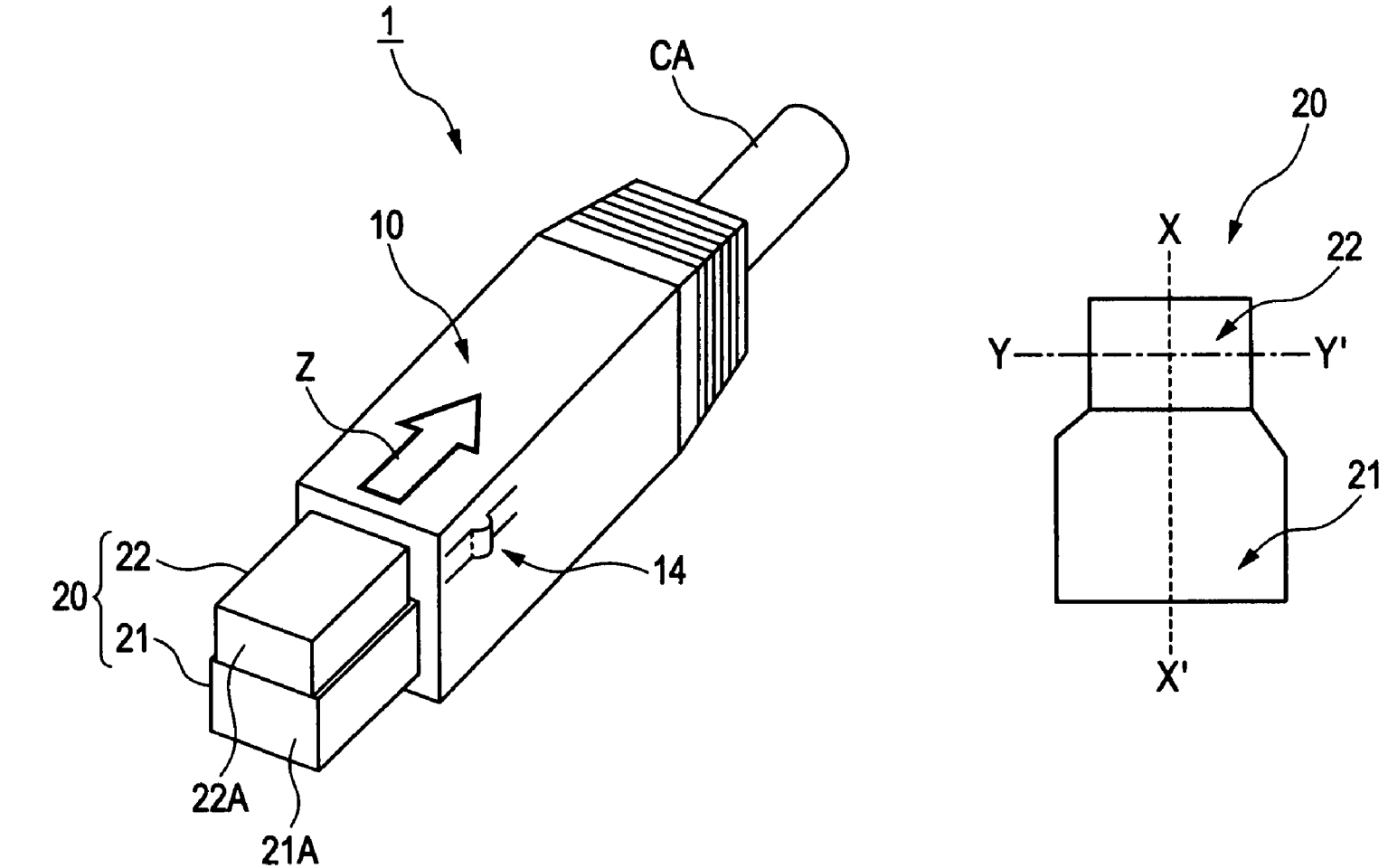
FIG. 1 is a pair of general perspective view and front view showing a connector according to one embodiment of the present invention.
Figure 2A:
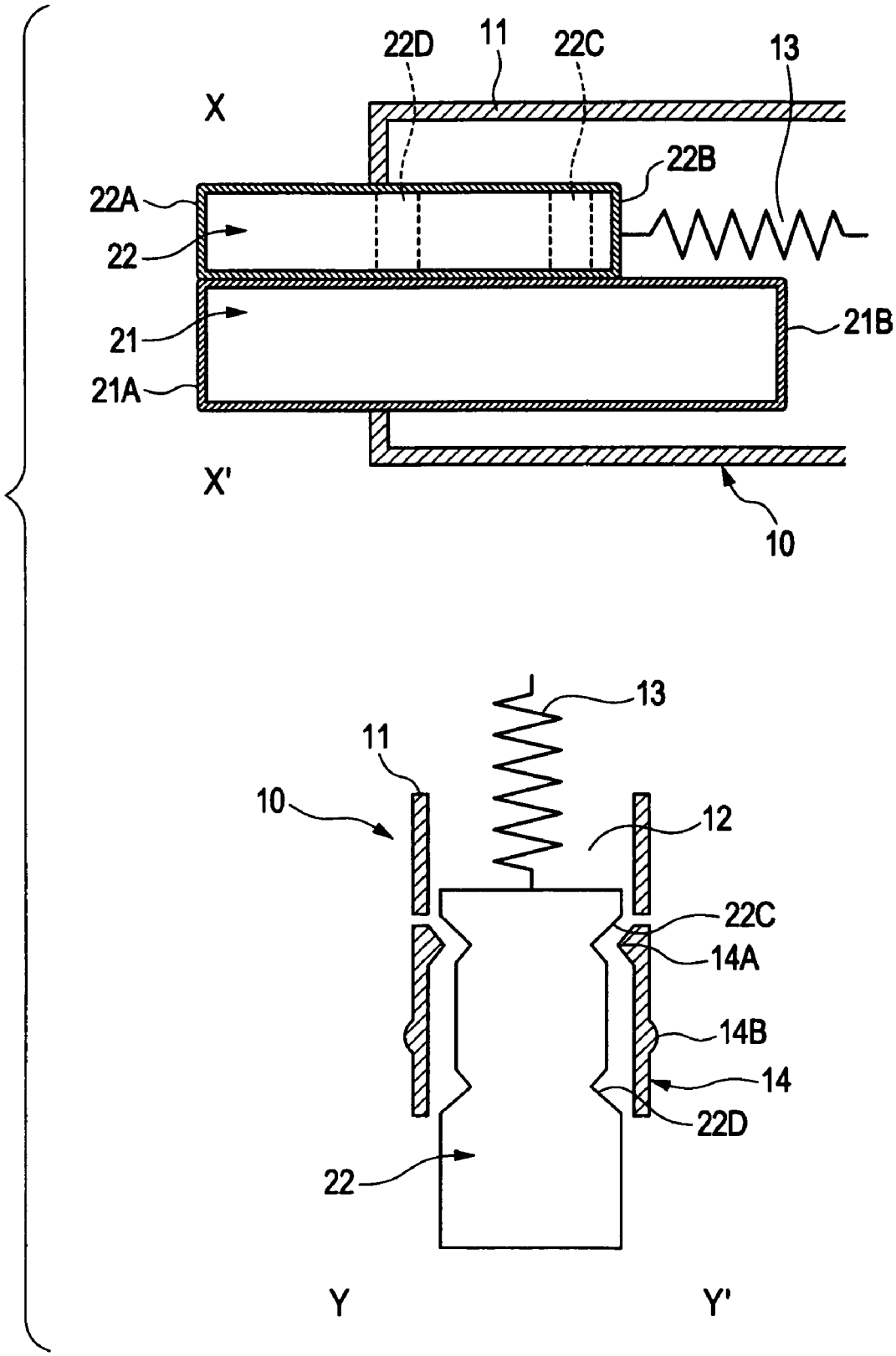
FIG. 2A is a pair of vertical sectional view and horizontal sectional view showing the connector with an uninserted second connector block.
Figure 2B:
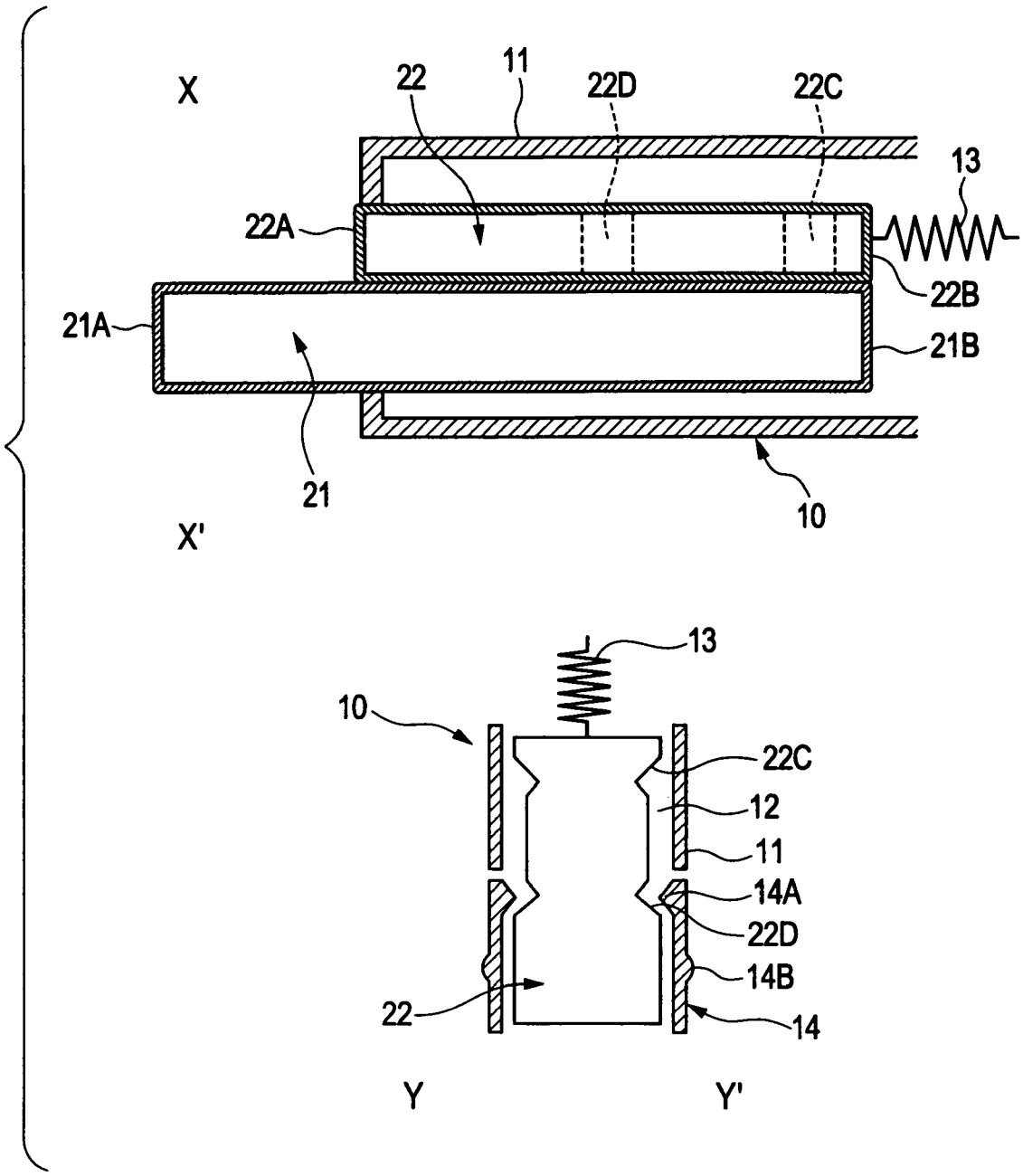
FIG. 2B is a pair of vertical sectional view and horizontal sectional view showing the connector with the inserted second connector block.
Figure 2C:
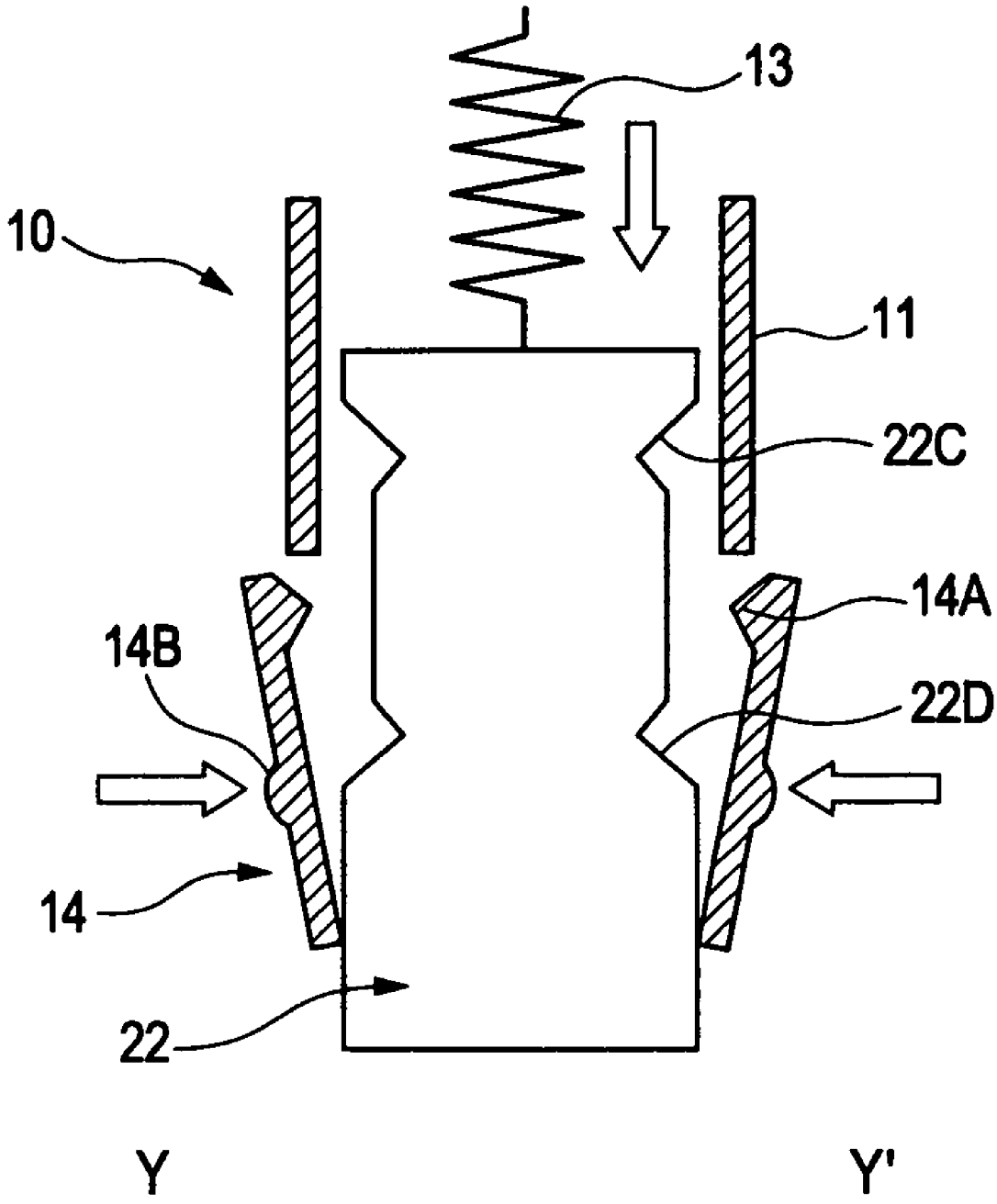
FIG. 2C is a horizontal sectional view showing a releasing structure for releasing the inserted second connector block.
Figure 3A:
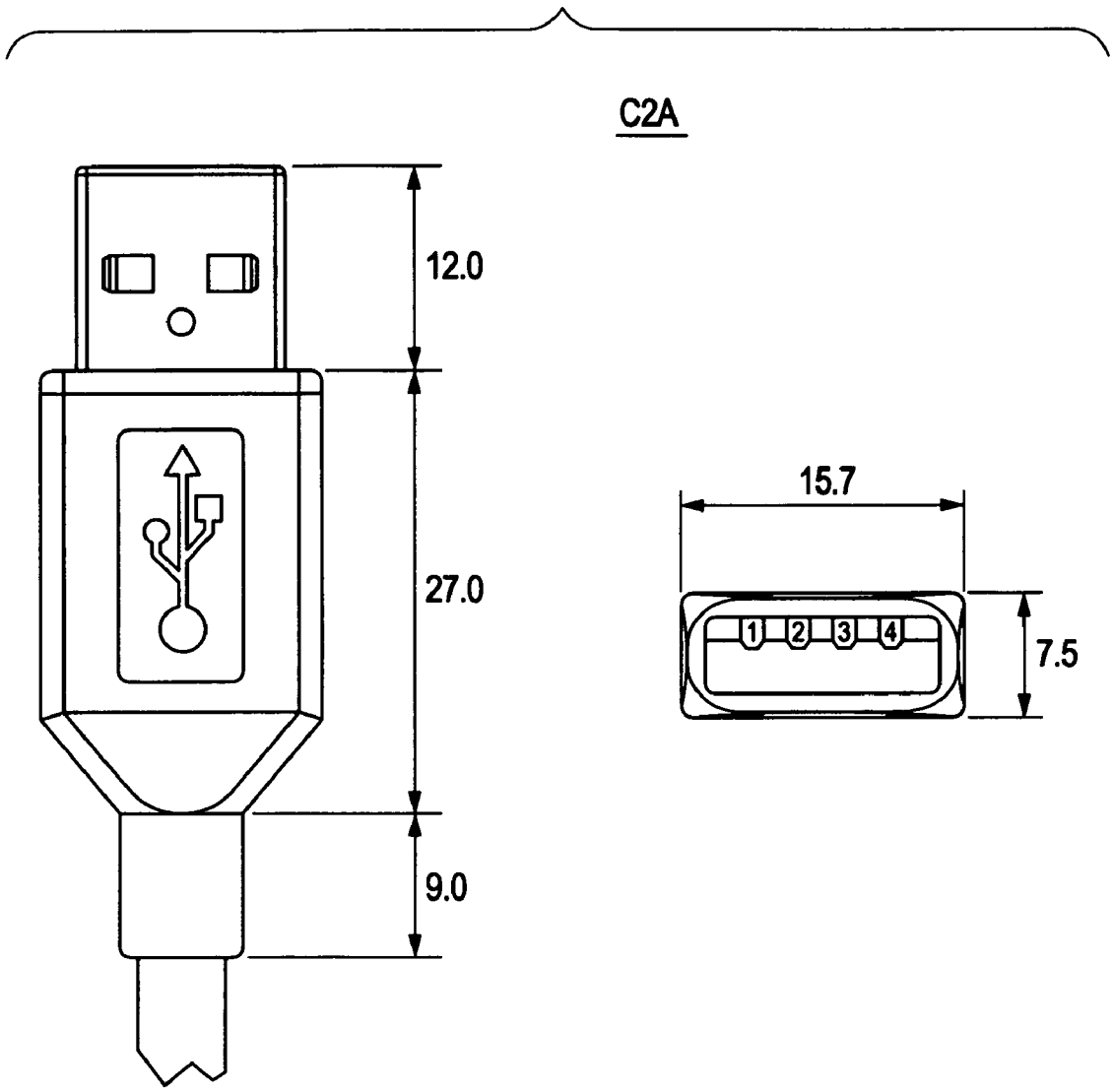
FIG. 3A is a pair of diagrams showing a USB2.0 Std-A connector.
Figure 3B:
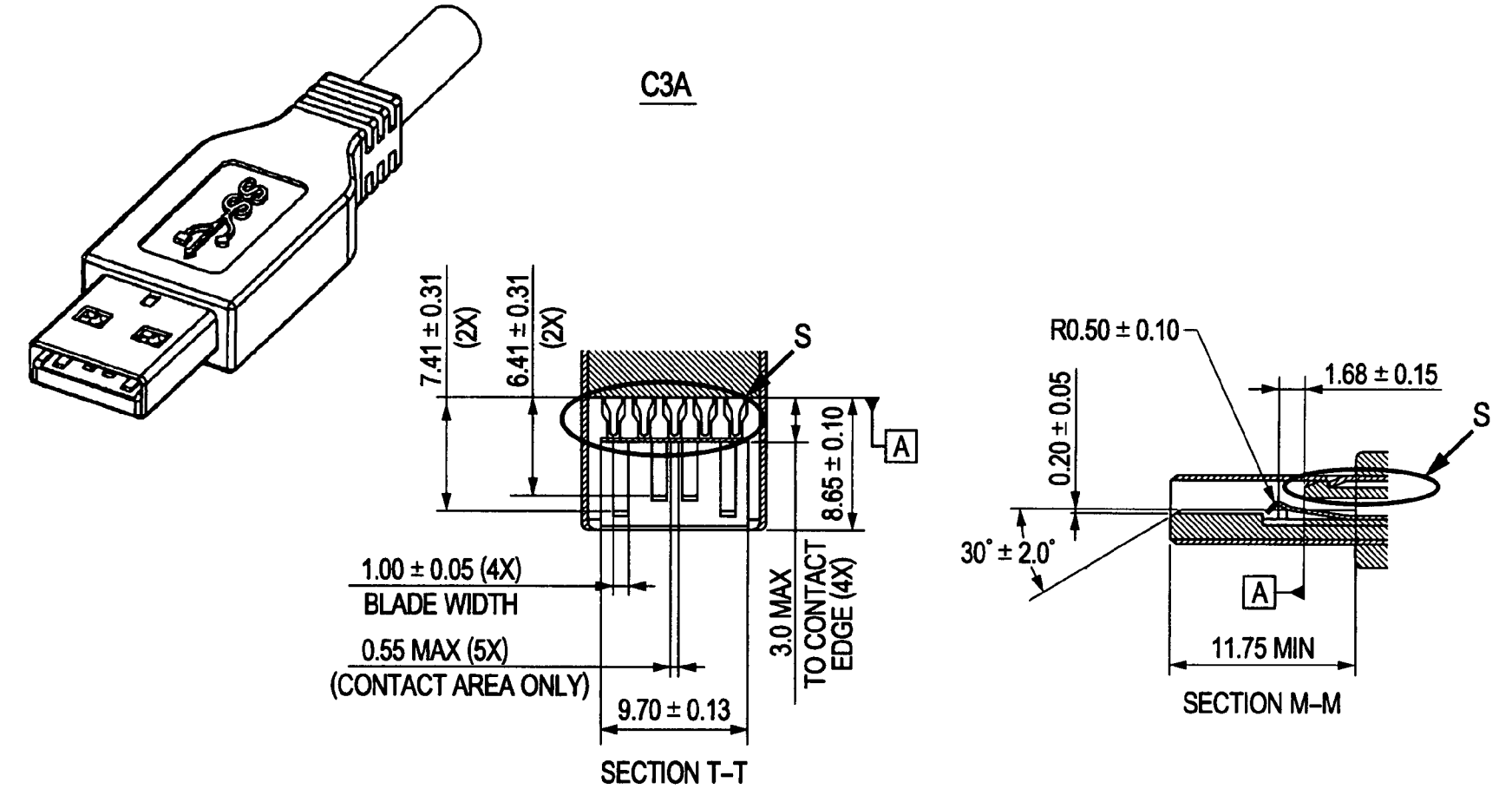
FIG. 3B is a group of diagrams showing a USB3.0 Std-A connector.
Figure 3C:
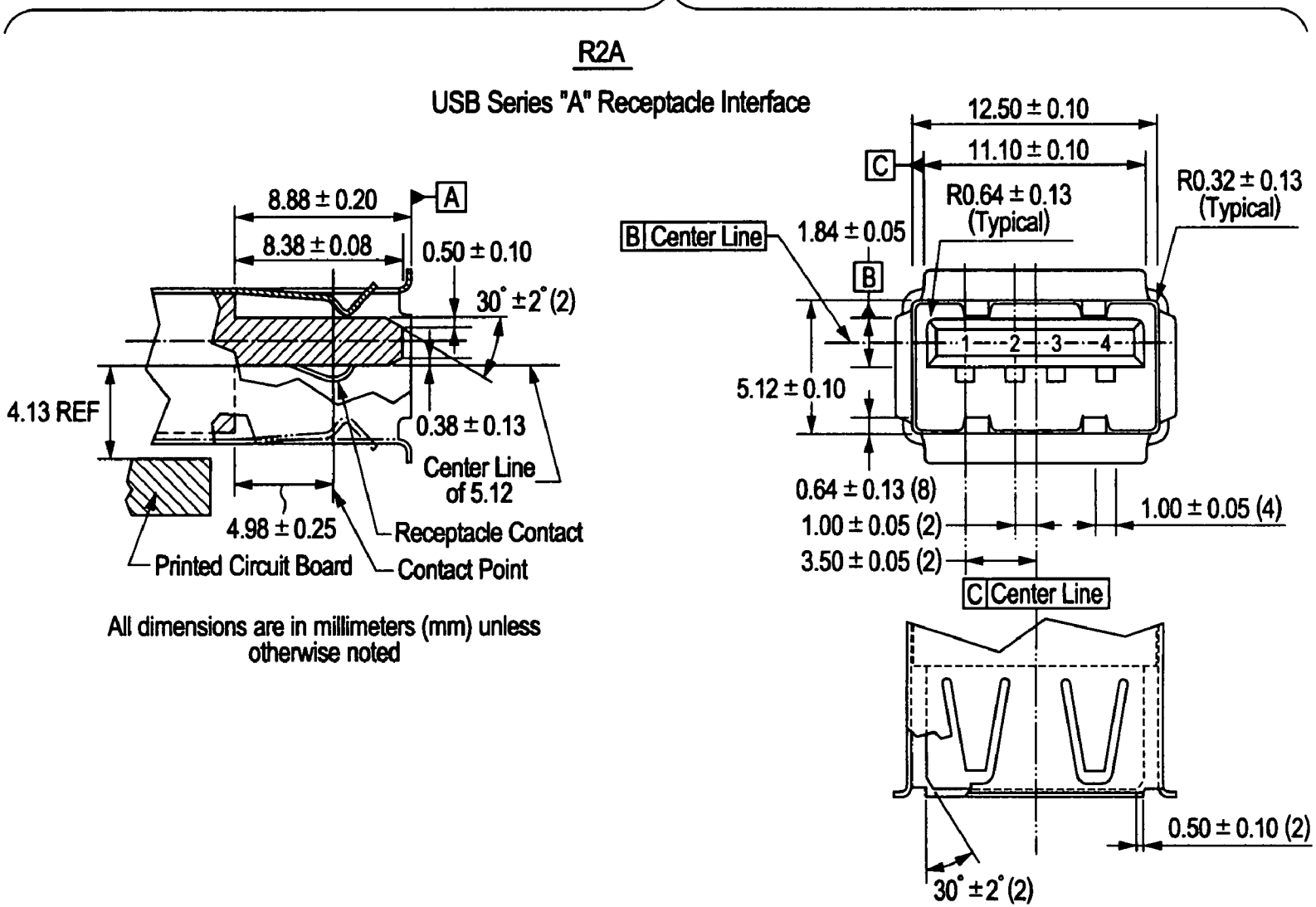
FIG. 3C is a group of diagrams showing a USB2.0 Std-A receptacle.

FIG. 1 is a pair of general perspective view (the left-hand diagram) and front view (the right-hand diagram) showing the connector according to the embodiment hereof. FIG. 2A is a pair of vertical sectional view and horizontal sectional view showing the connector with an uninserted second connector block. FIG. 2B is a pair of vertical sectional view and horizontal sectional view showing the connector with the inserted second connector block. FIG. 2C is a horizontal sectional view showing a releasing structure for releasing the inserted second connector block. The vertical sectional view is taken on the line X-X' in the right-hand diagram of FIG. 1. The horizontal sectional view is taken on the line Y-Y' in the right-hand diagram of FIG. 1.

In the drawings, individual components are not drawn to scale for the sake of viewability. In the sectional views, cross hatchings are arbitrarily omitted.

A connector 1 of the embodiment shown in FIG. 1 and FIGS. 2A to 2C is a USB3.0 Std-B connector that is also usable as a USB2.0 Std-B connector.

As shown in FIG. 1, the connector 1 of the embodiment is attached to a distal end of a USB3.0 cable CA or the like and coupled to a USB receptacle installed in an electronic device such as a personal computer. The USB3.0 cable CA equipped with the connector 1 of the embodiment is also usable as a USB2.0 cable.

The connector 1 of the embodiment includes a connector body 10 substantially shaped like a rectangular cuboid, and a connector portion 20 partially inserted in the connector body 10 and partially projected from the connector body 10.

Figure 4A:
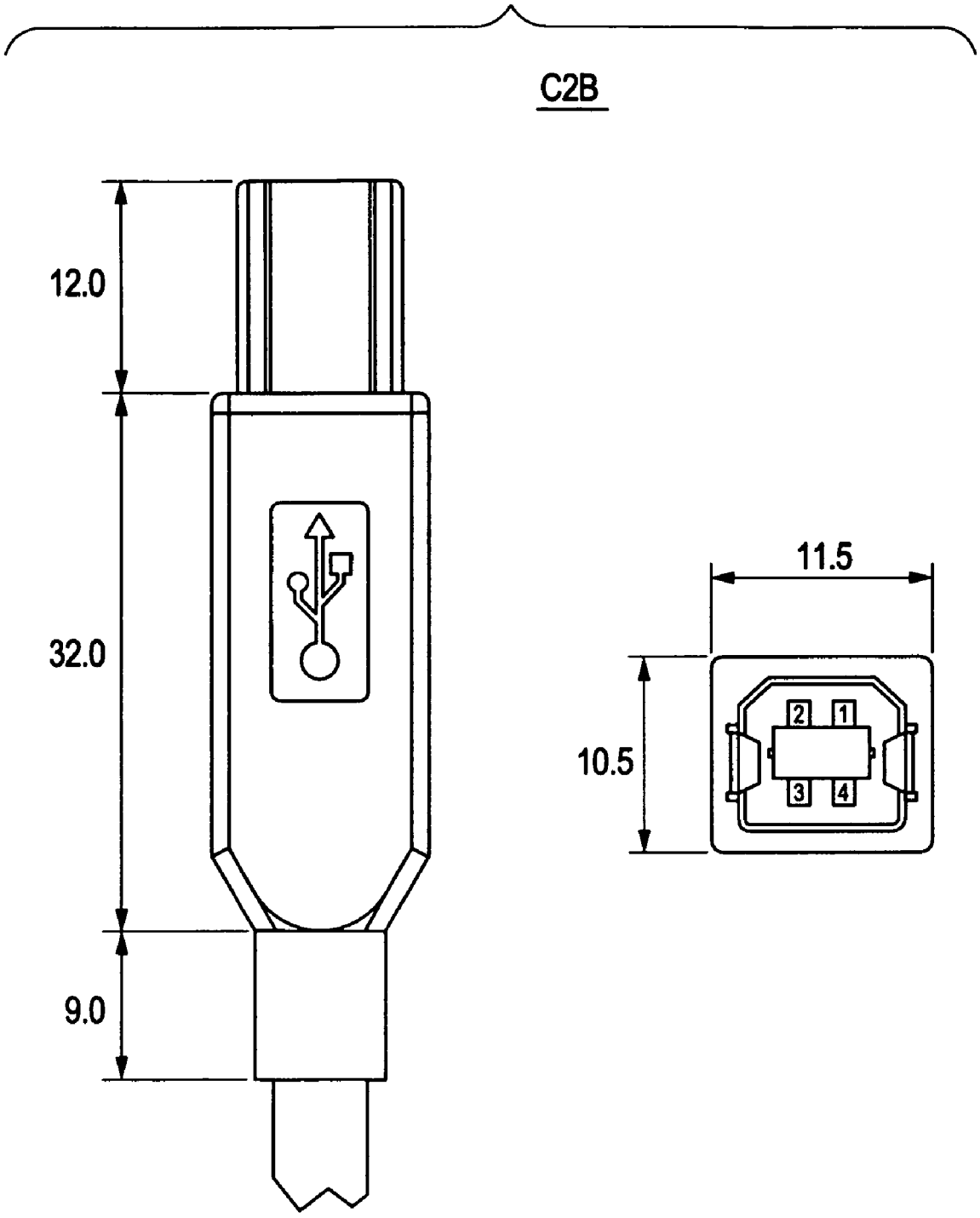
FIG. 4A is a pair of diagrams showing a USB2.0 Std-B connector.
Figure 4B:
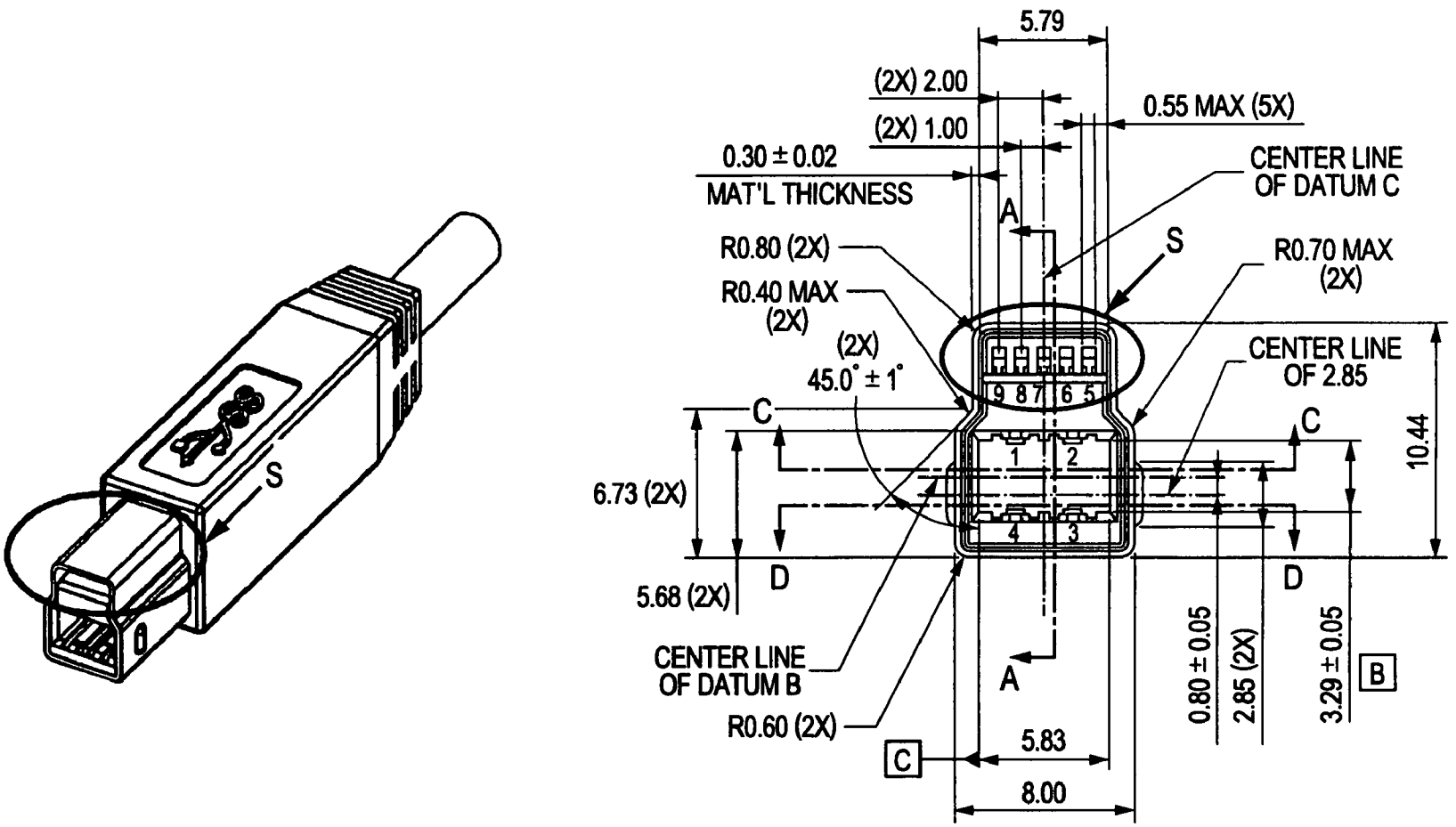
FIG. 4B is a pair of diagrams showing a USB3.0 Std-B connector.
Figure 4C:
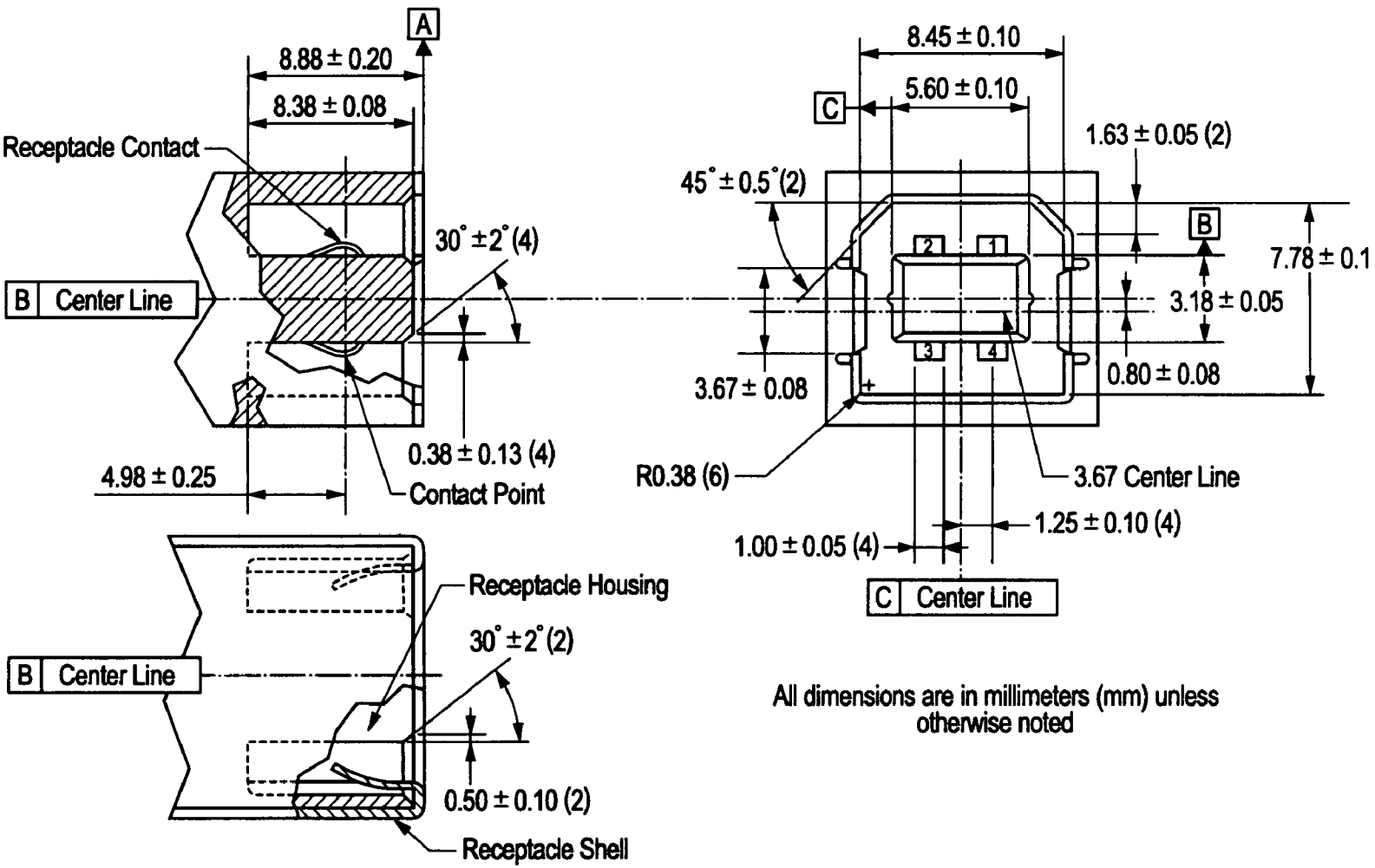
FIG. 4C is a group of diagrams showing a USB2.0 Std-B receptacle.
Figure 4D:
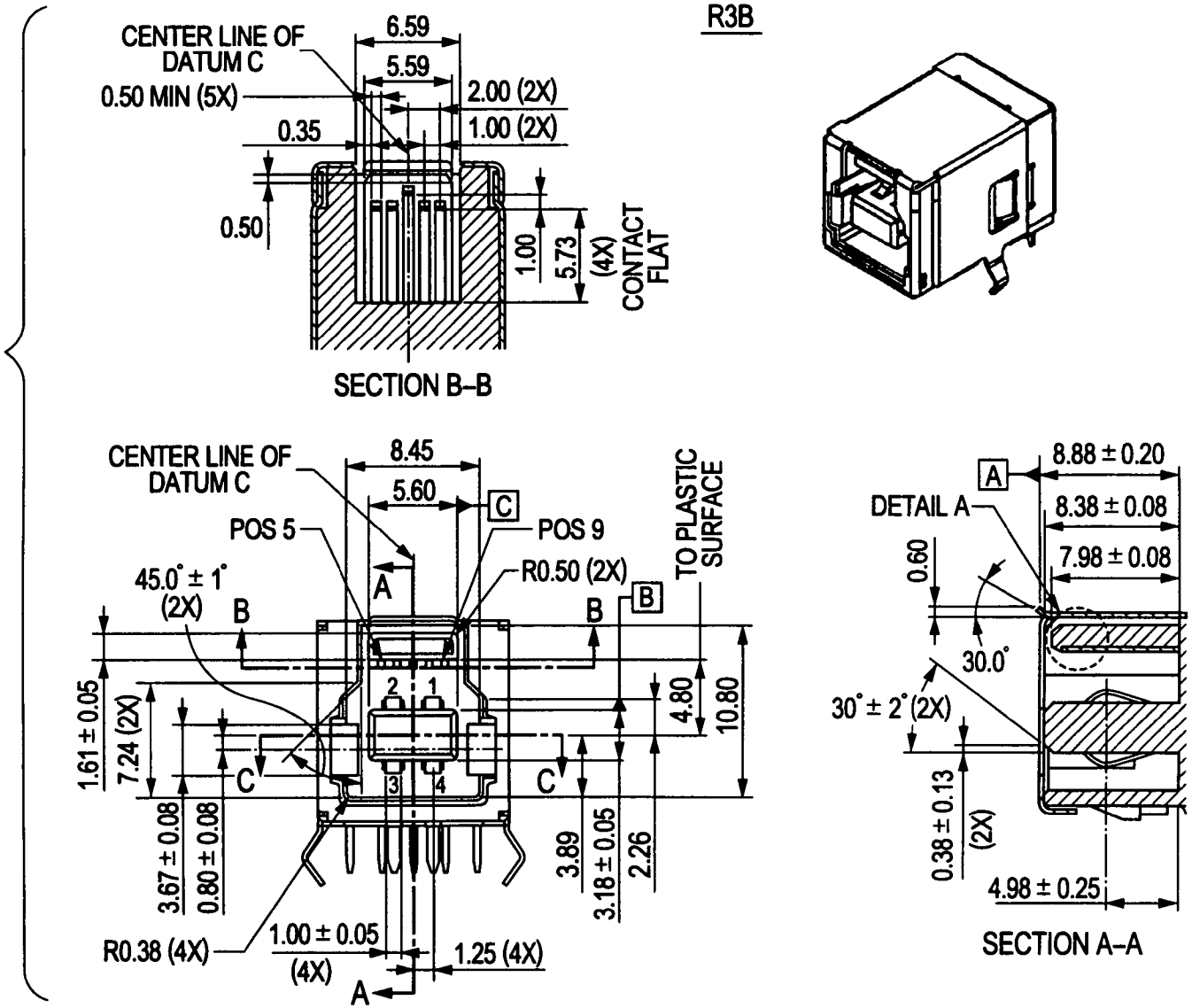
FIG. 4D is a group of diagrams showing a USB3.0 Std-B receptacle.

According to the embodiment, the connector portion 20 includes:

a first connector block 21 that has a substantially rectangular cuboid shape and that is singularly capable of mating with a USB2.0 Std-B receptacle (see FIG. 4C) conforming to a first specification but is singularly incapable of mating with a USB3.0 Std-B receptacle (see FIG. 4D) conforming to a second specification, and a second connector block 22 that has a substantially rectangular cuboid shape and that is disposed on the first connector block 21 and combined with the first connector block 21 to be capable of mating with the USB3.0 Std-B receptacle conforming to the second specification.

The second connector block 22 is a connector block including a Super Speed line structure (SS line).

In this embodiment, the second connector block 22 is free to slide on the first connector block 21 and to be inserted in the connector body 10, as shown in FIGS. 2A to 2C. In FIG. 1, a sliding direction of the second connector block 22 is indicated by a reference character Z. While the figure shows the direction in which the second connector block 22 is moved into the connector body 10, the second connector block 22 is also slidable in a direction to move out of the connector body 10.

According to the embodiment, the second connector block 22 has a shorter length (in the sliding direction Z) than that of the first connector block 21. When the second connector block 22 is not inserted in the connector body, a forward end 22A of the second connector block 22 is aligned with a forward end 21A of the first connector block 21, as shown in the upper diagram of FIG. 2A. When the second connector block 22 is inserted in the connector body, a rear end 22B of the second connector block 22 is aligned with a rear end 21B of the first connector block 21, as shown in the upper diagram of FIG. 2B. However, the rear ends of the first connector block 21 and the second connector block 22 are not necessarily be in alignment but may be out of alignment.

In this embodiment, a respective side on which the first connector block 21 and the second connector block 22 are mated with the receptacle is defined as "forward end side", while a respective side of the connector blocks that is proximal to a cable body is defined as "rear end side".

The connector body 10 includes a housing 11, a chamber 12 capable of receiving the second connector block 22, and an elastic pushing member 13 for pushing the second connector block 22, received in the chamber, out of the chamber 12. According to the embodiment, the pushing member 13 comprises a spring material.

According to the embodiment, the connector body 10 and the second connector block 22 are provided with a first locking structure for locking the second connector block 22 to the connector body 10 when the second connector block 22 is not inserted in the connector body, and a second locking structure for locking the second connector block 22 to the connector body 10 when the second connector block 22 is inserted in the connector body. The connector body 10 is further provided with an unlocking structure for releasing the second connector block 22 received in the chamber 12 and locked to the connector body 10.

Specifically, the connector body 10 is provided with a locking member 14 that includes two locking pieces 14A projecting from an inside surface of the chamber 12 and that can be opened outward relative to the chamber 12 at its portion at least including the locking pieces 14A.

The second connector block 22 is formed with two first lock grooves 22C into which the locking pieces 14A of the connector body 10 are locked when the second connector block 22 is not inserted in the connector body, and two second lock grooves 22D into which the locking pieces 14A of the connector body 10 are locked when the second connector block 22 is inserted in the connector body.

The locking pieces 14A of the connector body 10 and the first lock grooves 22C of the second connector block 22 constitute the first locking structure for locking the second connector block 22 to the connector body 10 when the second connector block 22 is not inserted therein. The locking pieces 14A of the connector body 10 and the second lock grooves 22D of the second connector block 22 constitute the second lock structure for locking the second connector block 22 to the connector body 10 when the second connector block 22 is inserted therein.

Although FIG. 2A illustrates the locking pieces 14A and the lock grooves 22C in spaced relation for the sake of viewability, these components actually come into mutual contact and lock to each other. Similarly, FIG. 2B illustrates the locking pieces 14A and the second lock grooves 22D in spaced relation but actually, these components come into mutual contact and lock to each other.

While the drawings illustrate the wedge-shaped locking pieces 14A and lock grooves 22C and 22D, the configuration thereof is not limited to this. These components may be designed in any configuration that allows these components to lock to each other.

The locking member 14 includes projections 14B shifted from the locking pieces 14A toward the forward end side and projected from an outside surface of the housing 11. The locking member 14 is designed to be pivotable on the projections 14B so as to rotate in a plane parallel to the sliding direction Z of the second connector block 22. As shown in FIG. 2C, the portion of the locking member 14 that includes the locking pieces 14A can be opened outward relative to the chamber 12 by pushing the projections 14B from outside and bringing the locking member 14 into rotation. According to the embodiment, the above-described arrangement provides the unlocking structure for unlocking the first locking structure including the locking pieces 14A of the connector body 10 and the first lock grooves 22C of the second connector block 22 and for unlocking the second locking structure including the locking pieces 14A of the connector body 10 and the second lock grooves 22D of the second connector block 22.

Now description is made on the action of the connector 1 of the embodiment.

When the second connector block 22 is not inserted in the connector body, as shown in FIG. 2A, the second connector block 22 is locked to the connector body 10 by the first locking structure including the locking pieces 14A of the connector body 10 and the first lock grooves 22C of the second connector block 22.

When the second connector block is not inserted in the connector body, the projections 14B are pushed from outside to rotate the locking member 14 so that the locking member 14 is opened outward relative to the chamber 12 at its portion including the locking pieces 14A. Thus is unlocked the first locking structure including the locking pieces 14A of the connector body 10 and the first lock grooves 22C of the second connector block 22.

Next, the second connector block 22 is pushed from outside in the sliding direction Z so as to contract the pushing member 13. As shown in FIG. 2B, the second connector block 22 is inserted in the chamber 12 so that the second connector block 22 is locked to the connector body 10 by the second locking structure including the locking pieces 14A of the connector body 10 and the second lock grooves 22D of the second connector block 22. This locking condition prevents the second connector block 22 from being pushed any further into the connector body 10, fixing the second connector block at place in the connector body 10.

With the second connector block inserted in the connector body, the projections 14B are pushed from outside to rotate the locking member 14 so that the locking member 14 is opened outward relative to the chamber 12 at its portion including the locking pieces 14A. Thus is unlocked the second locking structure including the locking pieces 14A of the connector body 10 and the second lock grooves 22D of the second connector block 22. This allows the pushing member 13 to expand and push out the second connector block 22, returning the second connector block to the uninserted position shown in FIG. 2A.

For configuration of internal terminal or the like of the connector 1 according to the embodiment, please refer to Universal Serial Bus 3.0 Specification, Revision 1.0 and Japanese Patent Application Publication No. 2009-272290 cited in the section of the background art.

As described above, the connector 1 of the embodiment permits the second connector block 22 to be inserted in the connector body 10 as required. Therefore, the connector can use the first connector block 21 alone for mating engagement with the USB2.0 Std-B receptacle (see FIG. 4C) conforming to the first specification. Further, the connector can also use the first connector block 21 together with the second connector block 22 for mating engagement with the USB3.0 Std-B receptacle (see FIG. 4D) conforming to the second specification. Accordingly, the connector 1 of the embodiment is connectable to the receptacles of different specifications whereas a connector of the prior-art configuration is not adapted for the connection with such receptacles.

According to the existing specification for standard B, the USB 3.0 cable equipped with the USB3.0 Std-B connector C3B is not usable as the USB2.0 cable. However, the use of the connector 1 of the embodiment eliminates the need for preparing two types of USB cables for USB2.0 connection and USB3.0 connection and using either one of the cables as required by the circumstance. This results in a notable improvement of convenience.

The present invention is not limited to the above-described embodiment but changes in design may be made thereto within the spirit and scope of the invention.

The present invention is applicable not only to the USB2.0 specification and USB3.0 specification but also to any future specifications.

What is claimed is:

1. A connector comprising:

a connector body; and a connector portion partially inserted in the connector body and partially projected from the connector body, wherein the connector portion includes: a first connector block that is singularly capable of mating with a receptacle conforming to a first specification but is singularly incapable of mating with a receptacle conforming to a second specification; and a second connector block that is disposed on the first connector block and combined with the first connector block to be capable of mating with the receptacle conforming to the second specification, and wherein the second connector block is free to slide on the first connector block and to be inserted in the connector body.

2. The connector according to claim 1, wherein the connector body is provided therein with a chamber capable of receiving the second connector block and an elastic pushing member for pushing the second connector block, received in the chamber, out of the chamber, wherein the connector body and the second connector block are provided with a first locking structure for locking the second connector block to the connector body when the second connector body is not inserted in the connector body, and a second locking structure for locking the second connector block to the connector body when the second connector block is inserted in the connector body, and wherein the connector body is provided with an unlocking structure for releasing the second connector block received in the chamber and locked to the connector body.

3. The connector according to claim 2, wherein the connector body is provided with a locking piece projecting from an inside surface of the chamber, and wherein the second connector block is provided with a first lock groove into which the locking piece of the connector body is locked when the second connector block is not inserted in the connector body, and a second lock groove into which the locking piece of the connector body is locked when the second connector block is inserted in the connector body.

4. The connector according to claim 3, wherein the connector body is provided with a locking member that includes the locking piece and can be opened outward relative to the chamber at its portion at least including the locking piece.

5. The connector according to claim 2, wherein the pushing member comprises a spring material.

6. The connector according to claim 1, wherein the first connector block is a USB (Universal Serial Bus) 2.0 Standard-B connector block, and wherein the connector portion comprising the combination of the first connector block and the second connector block is a USB3.0 Standard-B connector portion.

* * * * *